US007179235B2

(12) United States Patent
Meunier

(10) Patent No.: US 7,179,235 B2
(45) Date of Patent: Feb. 20, 2007

(54) APPARATUS FOR PERFORMING ASSESS-PRESS-PULL MASSAGING

(76) Inventor: Alain Meunier, 14, Route de Gray, Quetigny (FR) 21800

( * ) Notice: Subject to any disclaimer, the term of this patent is extended or adjusted under 35 U.S.C. 154(b) by 309 days.

(21) Appl. No.: 10/475,982

(22) PCT Filed: Apr. 29, 2002

(86) PCT No.: PCT/FR02/01481

§ 371 (c)(1),
(2), (4) Date: Apr. 26, 2004

(87) PCT Pub. No.: WO02/087487

PCT Pub. Date: Nov. 7, 2002

(65) Prior Publication Data

US 2005/0177075 A1 Aug. 11, 2005

(30) Foreign Application Priority Data

Apr. 27, 2001 (FR) ..... 01 05673

(51) Int. Cl.
*A61H 7/00* (2006.01)

(52) U.S. Cl. ..... 601/6; 601/11

(58) Field of Classification Search ..... 601/10–14, 601/123, 126, 133, 134, 6–7
See application file for complete search history.

(56) References Cited

U.S. PATENT DOCUMENTS 1,663,167 A 3/1928 Walter
4,729,368 A * 3/1988 Guitay ..... 601/123
5,891,064 A 4/1999 Van Herk et al.
5,961,475 A * 10/1999 Guitay ..... 601/7

FOREIGN PATENT DOCUMENTS

| | | |
|---|---|---|
| FR | 804 578 | 10/1936 |
| FR | 2 797 183 | 2/2001 |
| WO | WO 00 00109 | 1/2000 |

* cited by examiner

*Primary Examiner*—Michael A. Brown
(74) *Attorney, Agent, or Firm*—Young & Thompson

(57) ABSTRACT

An apparatus for massaging the human body, for use in particular in performing an assess/press/pull type massage, includes a working head (1) open in its lower part and containing elements for forming a skin fold. The elements forming a skin fold comprise two pinching skin-pinching jaws (11, 12) pivoting about an axis (13) parallel to the plane of the skin and at the ends of which are fixed massaging fingers (11*b*, 12*b*), the apparatus comprising elements for pivoting the two jaws (11, 12) towards each other and inversely. Additionally, the elements forming a skin fold advantageously comprise a suction cup (19) mounted mobile between the two jaws (11, 12), connected to a vacuum source by a flexible conduit (27) and elements (22, 24, 25) for moving the suction cup (19) vertically.

20 Claims, 3 Drawing Sheets

Figure 1:
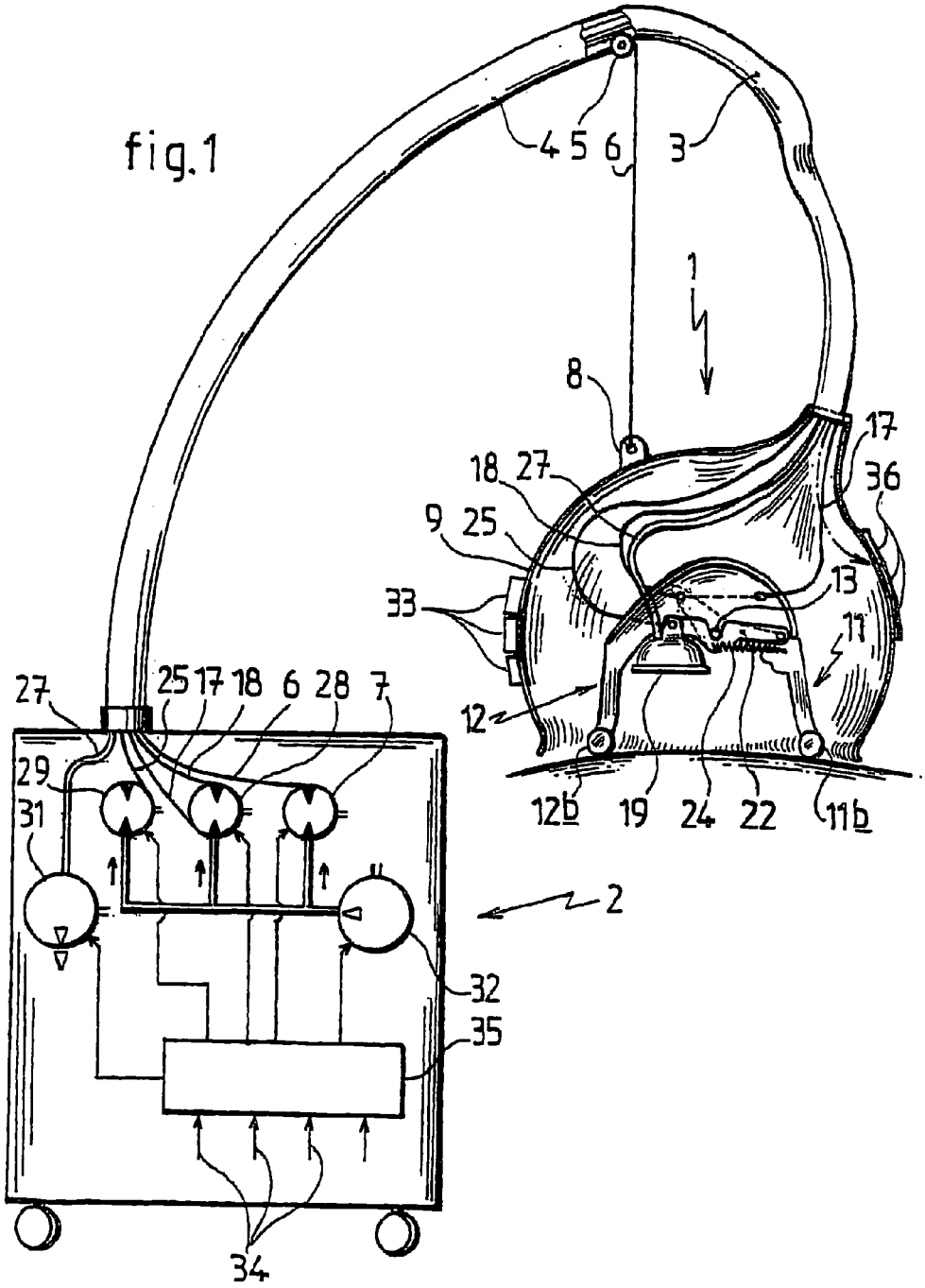

4 5 6 3
1
8
17
36
18 27
9 25
13
33
11
12
12b 19 24 22 11b
27
25 17 18 6 28 7
29
31
2
32
35
34

APPARATUS FOR PERFORMING ASSESS-PRESS-PULL MASSAGING

BACKGROUND OF THE INVENTION

The present invention relates to massage equipment for the human body, which can be used in particular to perform an assess press-pull type massage.

DESCRIPTION OF THE RELATED ART

There is various equipment currently being marketed which enables a probe-roll type massage to be performed. This equipment generally comprises, inside a casing open at its lower part and which is placed on the skin, a pair of rollers having parallel axes, in contact with the skin and pinching the latter to form a skin fold. The formation of the fold is previously obtained by creating a depression in the internal space of the casing, above the rollers, in order to suction the skin upwards. To this effect, the interior of the casing is connected to a vacuum source. The disadvantage of known equipment of this type is the intensity of compression to which the skin forming the fold pinched between the rollers is subjected, depending on the intensity of the depression. In effect, it is the same motor force which met en action les mechanical pieces ensuring the two functions of suction and compression of the skin. Regulating the depression acts simultaneously on the two movements without it being possible to favour either one of the actions and control the intensity of the action of the pressure or the traction on the skin. In addition, this known equipment cannot act directly beyond a depth of 2.5 to 3 cm. This limitation is due to the fact the compression is exerted parallel to the surface of the zone of treated skin, as a consequence of the fact that, during the gripping operation of the fold of skin, the two rollers converge by rectilinear translation parallel to the skin. The limitation is due on one hand to the dimensions of the suction surface and on the other hand to the fact that the motor force (depression) can harm the patient if it exceeds a certain value.

SUMMARY OF THE INVENTION

The aim of the present invention is to rectify these disadvantages by providing massage equipment which is very comfortable to use, in particular allowing very easy adjustment of the intensity and amplitude of each of the functions of suction and compression of the skin, to more significant depths and with finer and more precise levels of intensity.

To this effect, this massage equipment for the human body, which can be utilised in particular for performing an assess press-pull type massage, comprising a working head open to its lower part, able to be moved over the skin containing means for forming a fold in the skin, is remarkable in that the means for forming a fold of skin comprise two jaws for gripping the skin pivoting about an axis parallel to the plane of the skin, carrying at their ends massage fingers and means to have the two jaws pivot towards one another and inversely, in order to respectively grip and release the skin between them to form a fold of skin.

It is understood that, compared to massage equipment of the prior art, formation of the skin fold and pinching the latter is carried out solely by the massage fingers fixed at the ends of the jaws, such that since the pinching exerted on the skin fold is not limited by the depression, a more significant pinching force can be applied to the skin fold to permit relief of the tissue being treated. It will be observed that massage fingers fixed at the ends of the jaws are understood to be fingers which are not mounted free in rotation at the ends of the jaws.

In accordance with a particularly advantageous characteristic of the equipment according to the present invention the means for forming a fold of skin comprise a suction cup mounted mobile between the two jaws, connected to a depression source via a flexible tube and means for moving the suction cup into a lower end position in which it is located substantially in the plane of the lower opening of the working head and in contact with the skin, and an upper end position so as to draw upwards the zone of skin located between the massage fingers of the two jaws to form a fold of this skin, inter alia.

Figure 2:
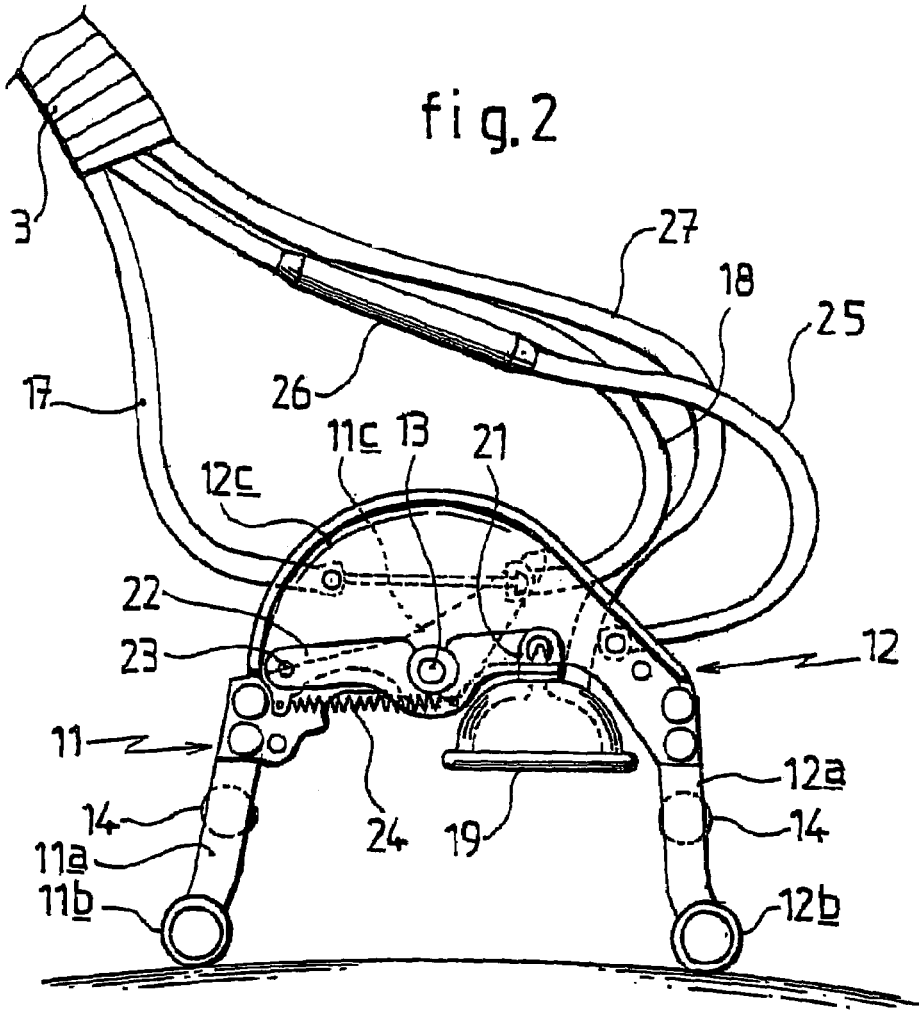
Figure 4:
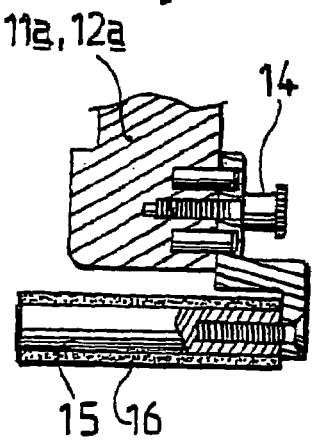
Figure 3:
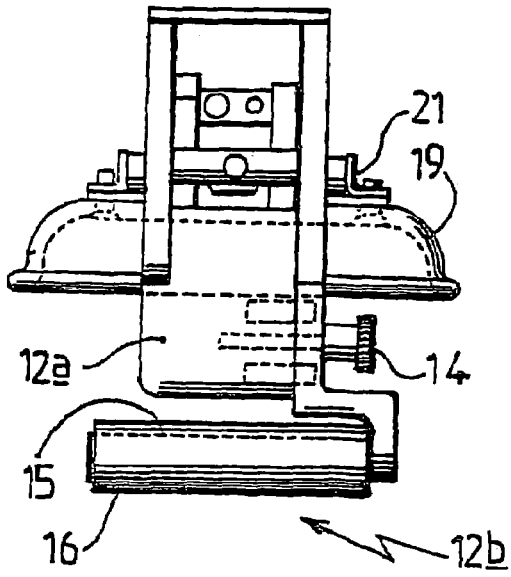
Figure 5:
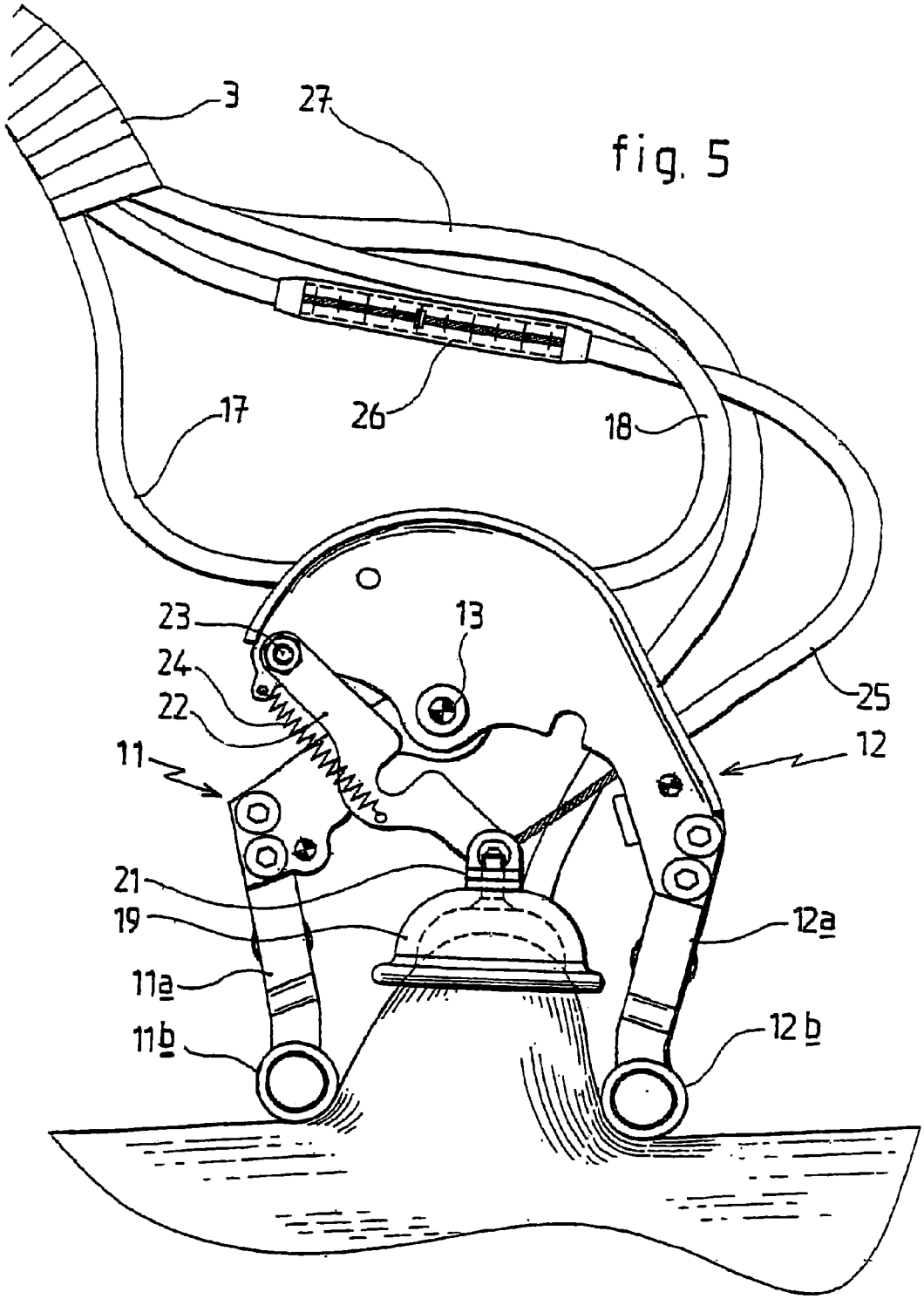

An embodiment of the present invention will now be described hereinafter by way of non-limiting example, with reference to the attached diagrams, in which:

FIG. 1 is a diagrammatic elevation, partially in vertical section, of massage equipment according to the present invention, with the working head being represented on an enlarged scale, FIG. 2 is an elevation of the main elements Making up the working head of the equipment, in a rest or inactive position, with the envelope of the head having been omitted, FIG. 3 is a profile view of the working head, shown from the right of FIG. 2, FIG. 4 is a vertical section of the lower part of a jaw, illustrating attachment of an interchangeable finger, FIG. 5 is an elevation of the main elements making up the working head illustrated in an active position of suction and compression of a fold of skin.

The massage equipment represented in FIG. 1 essentially comprises a working head 1 which is intended to be moved manually by a practitioner on the surface of the skin, to perform an assess press-pull type massage, as will be explained in greater detail hereinbelow, and an independent control unit 2, constituted by a chassis mounted mobile on rollers and containing various mechanical, electrical and electronic components enabling the various functions which will be specified hereinbelow. The working head 1 and the control unit 2 are attached to one another by a supple sheath 3 containing various conduits, electrical conductors, traction cables, etc. necessary for the working head 1 to function. The sheath 3 can be independent and can be attached directly to the control unit 2. All the same, in the particularly advantageous form of execution illustrated in FIG. 1, the sheath 3 is attached to the end of a bracket 4 located above the work table on which the patient lies. This bracket 4 is constituted by a tube, the lower end of which is fixed to the chassis of the control unit 2. The function of the bracket 4 is to house the electric cables, the tubes and the cables from the chassis of the control unit 2 to the point where they enter the supple sheath 3, in order to ensure fastening of one of the ends of the supple sheath 3, and to support, at its upper end, a pulley or other return system 5 for a lifting cable 6.

It is understood that the bracket 4 can be replaced by any type of lifting system such as a telescopic arm, for example, without departing from the scope of the invention. This cable 6 extends through the bracket 4 to a coiler 7 housed in the control unit 2 and it exits from the bracket 4 to extend vertically downwards as far as the working head 1, in the upper part of which it is attached at a point 8. The working head 1 comprises an envelope 9 open in the lower part, in the form of a bell, to which is connected the supple sheath 3 and which contains all the active elements of the head 1 constituting the compression mechanism for the skin and the suction mechanism for this skin. The skin compression mechanism comprises two jaws 11 and 12 articulated about a common intermediate axis 13, extending horizontally and supported by the envelope 9. Each jaw 11,12 comprises a respective lower arm 11*a*,12*a*, at the lower end of which is fixed a respective massage finger 11*b*,12*b*. Each massage finger 11*b*,12*b* is constituted by an interchangeable ensemble fixed on the lower part of its arm support by means of a button 14 and it comprises, at its lower end, a horizontal axis 15 on which a 16 is threaded. The material of the muff 16, in contact with the skin, constituting the external covering of each massage finger is selected so as to adapt the adherence and slide of each massage finger to the quality of the skin and to the treatment being carried out, with the aim of obtaining optimisation of comfort and efficacy of massage. In addition, the interchangeable massage fingers 11*b*, 12*b* have a diameter, a width and a form different in terms of the zone to be treated, the thickness of the fold to be formed, the sensitivity of the patient, etc.

As can be seen more particularly in FIG. 2, the lower arms 11*a*, 12*a* of the respective jaws 11, 12 move away from one another downwards in a rest or inactive position. The lower arms 11*a*, 12*a* are also fixed, at their upper ends, to respective caps 11*c*, 12*c* which pivot about the common horizontal axis 13. The cap 11*c* of the jaw 11 extends upwards, beyond the axis 13 and at its end part is attached the end of a locking cable 17 or of another means of motorisation housed in a sheath contained in the supple sheath 3. In similar fashion, the cap 12*c* of the jaw 12 is attached, in its part opposite the lower arm 12*a*, to the end of a release system, shown here by a release cable 18 housed in a sheath contained in the supple sheath 3. The disposition of the jaws 11, 12 and cables 17, 18 is such that traction exerted on the locking cable 17 causes simultaneous pivoting of the two jaws 11, 12 towards one another, effectively bringing the lower arms 11*a*,12*a* and the massage fingers 11*b*,12*b* closer together, and is also such that traction exerted on the release cable 18 causes an inverse pivoting movement initiating spreading of the jaws 11, 12.

The working head 1 likewise comprises a translucid suction cup 19 located between the upper end parts of the lower arms 11*a*,12*a*, in an inactive position, represented in FIG. 2. This suction cup 19 open to the bottom and variable in shape, adapted to the zone to be treated, extended parallel to the massage fingers 11*b*, 12*b* is fixed to a support 21, in turn swivel-mounted, at one end of a rocker bar 22. This rocker bar 22 is swivel-mounted at its other end, on its lower part of the cap 12*c* of the jaw 12, about a horizontal axis 23 parallel to the common pivot axis 13 of the two jaws 11, 12. The rocker bar 22 is forced downwards by a return spring 24 attached to the rocker bar 22 and in a point of the cap 12*c*. Due to this, the rocker bar 22 tends to pivot in a clockwise direction about the axis 23, thus causing the suction cup 19 to lower towards the surface of the skin. In addition, the mobile end of the rocker bar 22 on which the support 21 of the suction cup 19 is swivel-mounted, is connected to the end of a separation cable 25 housed in the supple sheath 3. Mounted on a section of the sheath of the cable 25 is a visual indicator 26 enabling the position of the separation cable 25 to be located and as a consequence that of the suction cup 19. This suction cup 19 is also connected to a suction pipe 27 which extends through the supple sheath 3.

The cables 17, 18, 21, 25 and the suction pipe 27 are connected to various elements of the control unit 2. More particularly the locking cables 17 and release cables 18 are connected, in the control unit 2, to respective coilers. These coilers can be constituted either by two independent jacks, or, preferably, by a single jack 28 with two rotating drums on which respectively, inversely, the cables 17 and 18 are wound. The separation cable 25 is connected to a coiler preferably made up by a rotating jack with single drum 29 and the suction pipe 27 is connected to a vacuum pump 31. The control unit 2 also contains a source of energy, such as a source of compressed air (compressor) 32 to feed and drive in rotation the jacks 7, 28, 29 driving the different cables 6, 17, 18, 21, and a control unit of the energy supplied to the different jacks.

The working head 1 likewise has various control buttons 33 which are connected by electric conductors 34 to a control circuit 35 of the control unit 2, which regulates the depression produced by the vacuum pump 31 for the suction cup 19 and the traction forces exerted by the jacks 7, 28, 29 on the respective cables 6, 17, 18, 21. The values of the depression and the forces applied or of the spreading of the massage fingers 11*b*,12*b* can also be retransmitted from the control unit 2 to indicators 36 carried by the working head 1. The working head 1 assumes two main functions. One of its functions is the formation of a fold of skin, followed by centrifugal mobilisation allowing elastic expansion of the tissues by suction and traction of the suction translucid cup 19, as shown in FIG. 5. The traction on the suction cup 19 is exerted by means of the cable 25 and the rocker bar 22. Controllable depression is applied in the suction cup 19 via the suction pipe 25. Another function of the working head 1 is massage by compression of the fold formed by the suction function, as shown in FIG. 5, or again the formation of the fold of skin and massage by direct compression by means of the two massage fingers 11*b*, 12*b*, then traction on the fold without any recourse to the suction function. Shrinking up of the lower arms 11*a*, 12*a* and the massage fingers 11*b*, 12*b* is ensured by traction exerted on the locking cable 17, while their release is ensured by traction exerted on the release cable 18.

According to the foregoing description, it is seen that one of the advantages provided by the equipment according to the present invention is that the depression created in the suction cup 19 is used to obtain adherence between the skin and the suction cup 19 and the formation of a fold, the work of the fold then being obtained by performing upward traction on the suction cup 19, by means of the separation cable 25. The significant suction surface avoids having to create strong depression in the suction cup, risking causing haematomas in the patients.

Another advantage provided by the equipment according to the present invention is that the compression function ensured by the jaws 11, 12 is totally autonomous and that the intensity of the compression can be adjusted fully independently of the value of the depression prevalent in the suction cup 19. Moreover, the depression chamber of the suction cup 19 is utilised as a means of prehension of the skin, while the working head 1 establishes a fixed point on a zone of the body.

Another particularity of the equipment according to the present invention is that the working head is suspended on the bracket 4 and the lifting cable 6 exerts on the head 1 an antagonistic force substantially equal to the weight of the head. Because of this, the work of the practitioner in moving the head 1 is clearly less tiring. In addition, for certain treatment, it is necessary to perform significant traction on the head 1 and here, the fact that the head 1 is suspended from the bracket 4 considerably alleviates the effort made by the practitioner. The head 1 can therefore be completely substituted by the traction applied by the practitioner. Even though, in the preferred embodiment of the abovedescribed massage equipment, the vacuum source 31, the coiler 29 of the separation cable 21, and the coiler 28 of the locking cables 17, 18 are housed in a control unit 2 remote from the working head 1, they could also, in a variant embodiment, be housed in the working head 1. The latter could then contain electric or pneumatic motors, controlling the movements of the jaws 11 and 12, pulling the suction cup 19 and creation of the vacuum therein. The working head 1 can also comprise force sensors helping to measure the force exerted between the jaws 11 and 12. This measure could be used to determine the limit not to be exceeded for performing massage on the patient in full safety.

According to a variant embodiment, the control unit 2 or the working head 1 comprises an automated component for coordinating the movements of the jaws 11, 12 and of the suction cup 19.

Finally, it is obvious that the massage equipment for the human body according to the present invention can be utilised without the suction cup 19, or then again it may comprise only two jaws for gripping the skin 11,12 pivoting about the axis 13 parallel to the plane of the skin, carrying, at their ends, the massage fingers 11*b*,12*b* and means to cause the jaws 11,12 to pivot towards one another and inversely, in order to respectively grip and release the skin between them to form a fold in this skin.

The invention claimed is:

1. Massage equipment for the human body, which can be used in particular for performing an assess press-pull type massage, comprising a working head (1) open in its lower part, capable of being moved on the skin, and containing means for forming a fold of skin, characterised in that the means for forming a fold of skin comprise two jaws for gripping the skin (11, 12) pivoting about an axis (13) parallel to the plane of the skin, carrying at their ends massage fingers (11*b*,12*b*), the fingers not being mounted free in rotation, and means to make the two jaws (11, 12) pivot towards one another and inversely, in order to respectively grip and release the skin between them to form a fold of skin, such that the fold formed can be worked by direct and autonomous compression using the massage fingers then by traction on the fold.

2. The equipment as claimed in claim 1 characterised in that a suction cup (19) mounted mobile between the two jaws (11, 12), connected to the depression source by a flexible tube (27) and means (22, 24, 25) for moving the suction cup (19) into a lower end position in which it is located substantially in the plan of lower opening of the working head (1) and in contact with the skin, and an upper end position so as to be able to draw the zone of the skin upwards which is located between the massage fingers (11*b*, 12*b*) of the two jaws (11, 12).

3. The equipment as claimed in claim 2 characterised in that the suction cup 19 is attracted to its lower end position by a spring (24) and to its upper end position by a separation traction cable (25).

4. The equipment as claimed in claim 3 characterised in that the suction cup (19) is mounted to pivot on a first end, located to one side of the pivot axis 13 of the two jaws (11, 12), a rocker bar (22), in turn swivel-mounted, at its second end, on a part of one of the jaws (12), about an axis (23) parallel to the pivot axis (13) and located on the other side of this axis (13).

5. The equipment as claimed in claim 3 characterised in that the separation traction cable (25) is housed in a sheath on which is interposed a visual display (26) showing the cable to indicate the axial position of the cable in its sheath and consequently the effective position of the suction cup (19).

6. The equipment as claimed in claim 1 characterised in that the two jaws (11, 12) are attached to locking traction cables (17) and release cables (18) respectively controlling the approach and spread of the jaws (11, 12) and their massage fingers.

7. The equipment as claimed in claim 1 characterised in that each of the jaws (11,12) comprises a lower arm (11*a*, 12*a*) on which is fixed, by means of a button (14), a massage finger, which is interchangeable, and whereof the shape is adapted to the zone to be treated.

8. The equipment as claimed in claim 7 characterised in that each massage finger (11*b*,12*b*) comprises an external covering material (16) selected so as to adapt the adherence and slide of each massage finger to the quality of the skin and to the treatment to be carried out, with the aim of obtaining optimal comfort and efficacy of massage.

9. The equipment as claimed in claim 1 characterised in that it comprises an independent control unit (2) comprising coilers (7, 28, 29) mechanical cables (6, 17, 18, 21), a power source (32) to drive the coilers (7, 28, 29), a vacuum pump (31) and an electric control circuit (35), a supple sheath (3) connecting the control unit (2) to the working head (1) and containing the mechanical cables (6, 17, 18, 21), the tube (25) connecting the vacuum pump (31) to the suction cup (19) and electric conductors, a first cable (21) connected to a first coiler (29) being connected to the suction cup (19) to cause the movement of the suction cup (19) upwards, a second mechanical cable (17) and a third mechanical cable (18) being connected to the two jaws (11,12) to control the pivot movement of these jaws and to a second coiler (28).

10. The equipment as claimed in claim 9 characterised in that it comprises a bracket (4) attached to its upper end, located above the work table, at one end of the supple sheath (3), the bracket (4) being constituted by a tube through which extend the tube (27), the mechanical cables (17, 18, 21) and the electric conductors.

11. The equipment as claimed in claim 10 characterised in that the control unit (2) contains a third coiler (7) for a mechanical lifting cable (6) passing through the bracket (4) and on a return element (5), such as a pulley, located at the upper end of the bracket (4), said lifting cable (6) being attached to the upper part of the working head (1) in a point (8).

12. The equipment as claimed in claim 9 characterised in that the working head (1) carries control and adjustment buttons (33) and control indicators (36) which are connected by electrical conductors passing through the supple sheath (3), to components of the control unit (2).

13. The equipment as claimed in claim 1 characterised in that it comprises force sensors for measuring the force exerted between the jaws (11) and (12).

14. The equipment as claimed in claim 9 characterised in that the control unit 2 or the working head 1 comprises an automated component for coordinating les movements of the jaws 11 and 12 and of the suction cup 19.

15. Massage equipment for the human body, comprising:

a working head (1) with an open lower part movable over skin of the body; and a forming part for forming a fold of skin, the forming part comprising two jaws (11, 12) for gripping the skin (11, 12) pivoting about an axis (13) parallel to the plane of the skin; and non-rotational massage fingers (11*b*,12*b*) non-rotary and fixed at the end of the jaws such that pivoting of the two jaws (11, 12) towards one another and inversely directs movement of the fingers in order to respectively grip and release the skin between them to form a fold of skin.

16. The equipment as claimed in claim 1 wherein a suction cup (19) is mounted mobile between the two jaws (11,12), connected to the depression source by a flexible tube (27) and means (22, 24, 25) for moving the suction cup (19) into a lower end position in which it is located substantially in the plan of lower opening of the working head (1) and in contact with the skin, and an upper end position so as to be able to draw the zone of the skin upwards which is located between the massage fingers (11*b*, 12*b*) of the two jaws (11,12).

17. The equipment as claimed in claim 15, wherein, each of the jaws (11,12) comprises a lower arm (11*a*,12*a*) on which is fixed, by means of a button (14), a massage finger, which is interchangeable, and whereof the shape is adapted to the zone to be treated.

18. The equipment as claimed in claim 15 further comprising an independent control unit (2) comprising coilers (7, 28, 29) mechanical cables (6, 17, 18, 21), a power source (32) to drive the coilers (7, 28, 29), a vacuum pump (31) and an electric control circuit (35), a supple sheath (3) connecting the control unit (2) to the working head (1) and containing the mechanical cables (6, 17, 18, 21), the tube (25) connecting the vacuum pump (31) to the suction cup (19) and electric conductors, a first cable (21) connected to a first coiler (29) being connected to the suction cup (19) to cause the movement of the suction cup (19) upwards, a second mechanical cable (17) and a third mechanical cable (18) being connected to the two jaws (11,12) to control the pivot movement of these jaws and to a second coiler (28).

19. Massage equipment for the human body, comprising:

a working head (1) with an open lower part movable over skin of the body; and a forming part for forming a fold of skin, the forming part comprising two jaws (11, 12) for gripping the skin (11, 12) pivoting about an axis (13) parallel to the plane of the skin; and massage fingers (11*b*,12*b*) fixed non-rotary at the end of the jaws, wherein the fingers move in responsive to movement of the jaws and pivoting the two jaws (11, 12) towards one another and inversely causes the fingers to respectively grip and release the skin between them to form a fold of skin such that the fold formed can be worked by direct and autonomous compression using the massage fingers then by traction on the fold.

20. The equipment as claimed in claim 19, wherein, each of the jaws (11,12) comprises a lower arm (11*a*, 12*a*) on which is fixed, by means of a release (14), one of the massage fingers, which one finger is interchangeable, and whereof the shape is adapted to the zone to be treated.

* * * * *